US005647423A

United States Patent [19]

Harms

[11] Patent Number: 5,647,423

[45] Date of Patent: Jul. 15, 1997

[54] BIFOLD DOOR

[76] Inventor: Uwe Harms, 2 Cotswold Dr., Milnerton, 7441, Cape Town, South Africa

[21] Appl. No.: 335,767

[22] PCT Filed: Mar. 8, 1994

[86] PCT No.: PCT/EP94/00686

§ 371 Date: Jan. 3, 1995

§ 102(e) Date: Jan. 3, 1995

[87] PCT Pub. No.: WO94/20715

PCT Pub. Date: Sep. 15, 1994

[30] Foreign Application Priority Data

Mar. 8, 1993 [ZA] South Africa ..... 93/1639

[51] Int. Cl.[6] ..... E05D 15/06

[52] U.S. Cl. ..... 160/206; 160/187; 49/449; 16/87 R

[58] Field of Search ..... 160/199, 185, 160/186, 206, 187; 16/91, 97, 106, 107, 87 R, 94 R; 49/177, 178, 179, 449, 409, 410; 4/557, 607, 610

[56] References Cited

U.S. PATENT DOCUMENTS

| | | | |
|---|---|---|---|
| 1,940,943 | 12/1933 | Ellison | 16/87 R |
| 2,990,566 | 7/1961 | Lee | 16/87 R |
| 3,073,382 | 1/1963 | Zimmerman et al. | 160/199 X |
| 4,276,919 | 7/1981 | Walters | 160/199 X |
| 4,872,287 | 10/1989 | Block | 49/449 |
| 4,932,455 | 6/1990 | Yamada | 160/199 |
| 4,981,164 | 1/1991 | Reichel | 160/199 X |
| 5,085,262 | 2/1992 | Tutikawa | 160/199 |

*Primary Examiner*—David M. Porol
*Attorney, Agent, or Firm*—James Ray & Associates

[57] ABSTRACT

A bifold door comprises a pair of door panels 12.1, 12.2 joined to one another along a centre hinge 14. Each door panel, at the end thereof remote from the center hinge, is supported on a track 16 by a runner assembly 18 to which the door panel is pivotally connected. Each runner assembly is provided with a cam 32 whereby the runner assembly can releasably be locked in position with respect to the track.

8 Claims, 3 Drawing Sheets

BIFOLD DOOR

BACKGROUND OF THE INVENTION

A bifold door is a type of door comprising two door panels which are joined to one another along a centre hinge. When the door is closed, the door panels extend at an angle of 180° to one another. When it is opened, the door panels hinge with respect to one another about the centre hinge, in the manner of a jack-knife, to extend at an angle of 0° or close to 0° with respect to one another.

Bifold doors are designed to open either to the right or to the left. A bifold door that has been designed for use in a left-opening configuration cannot, after it has been installed, be changed from one configuration to the other. This makes bifold doors inflexible in their installation and use. It is also difficult to clean them at the fixed end thereof and areas surrounding the fixed end.

SUMMARY OF THE INVENTION

It is an object of the present invention to provide a bifold door which can be used in either a right-opening or left-opening configuration and which can without difficulty, even after installation, be changed from one configuration to the other if desired, and which is easy to clean.

According to the invention there is provided a bifold door which comprises a pair of door panels joined to one another along a centre hinge having a hinge axis, each door panel being, at the end thereof remote from the centre hinge, pivotal about a pivot axis parallel to the hinge axis, one of the door panels being supported, at the end thereof remote from the centre hinge, by a runner assembly on a track, end the other door panel also being, at the end thereof remote from the centre hinge, supported by a runner assembly on the track.

Each runner assembly may be provided with locking means for releasably locking the runner assembly in position with respect to the track.

The locking means may comprise a cam which is pivotally displaceable with respect to the runner assembly about a cam axis, displacement of the cam about the cam axis bringing the cam into locking engagement with the track.

Each runner assembly may comprise a pair of longitudinally spaced runner wheels, the cam being disposed between the runner wheels.

The track may have a recess therein into which part of the cam enters when locking the respective runner assembly with respect to the track.

The track may have a lip on one side of the runner wheels for limiting transverse movement of the runner wheels with respect to the track, the cam being arranged to engage with the lip.

The invention will now be described in more detail, by way of example, with reference to the accompanying drawings.

DESCRIPTION OF THE PREFERRED EMBODIMENT

Figure 1B:
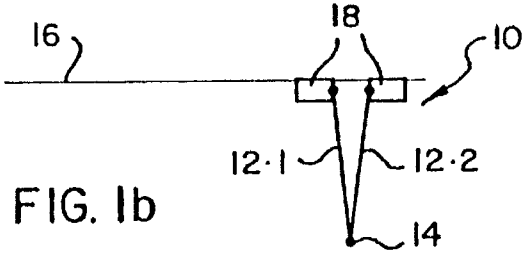
FIGS. 1*a* and 1*b* are diagrammatic views from above of a bifold door showing it respectively in the closed and open conditions.
Figure 1A:
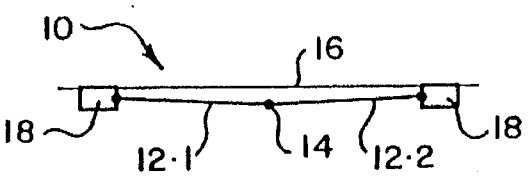

Referring first to FIGS. 1*a* and 1*b* reference numeral 10 generally indicates a bifold door having a pair of door panels 12.1 and 12.2 which are joined to one another along a hinge 14 having a vertical hinge axis. Each door panel 12.1, 12.2 is, at the end thereof remote from the hinge 14, supported on a track 16 via a runner assembly 18. There is such a track 16 (a head track) at the top and another such track (a cill track) at the bottom, each door panel 12.1, 12.2 being supported by a pair of the runner assemblies 18, one running on the head track 16, and the other on the cill track.

Referring now to FIGS. 2 to 7, the head track 16 forms part of an aluminium extrusion 20. The runner assembly 18 Comprises a pair of longitudinally spaced runner wheels 22 which are mounted for rotation on a runner body 24, the runner wheels 22 being supported on the head track 16. To prevent the runner wheels 22 from running laterally off the track 16, the track is provided with an upstanding lip 26.

The runner body 24 is connected to the door panel 12.1 via a pivotal connection 28, which permits the door panel to pivot with respect to the runner body 24 about a vertical pivot axis 30.

Between the two runner wheels 22 there is a cam element 32, the cam element having a protruding portion 34. The cam element 32 is pivotally displaceable with respect to the runner body 24 about cam axis 36, by being mounted at the end of a shaft 38 which passes through a bore in the cam body 24. At the other end of the shaft 38 there is a cam lever 40, whereby the cam can be displaced about the cam axis 38.

Figure 3:
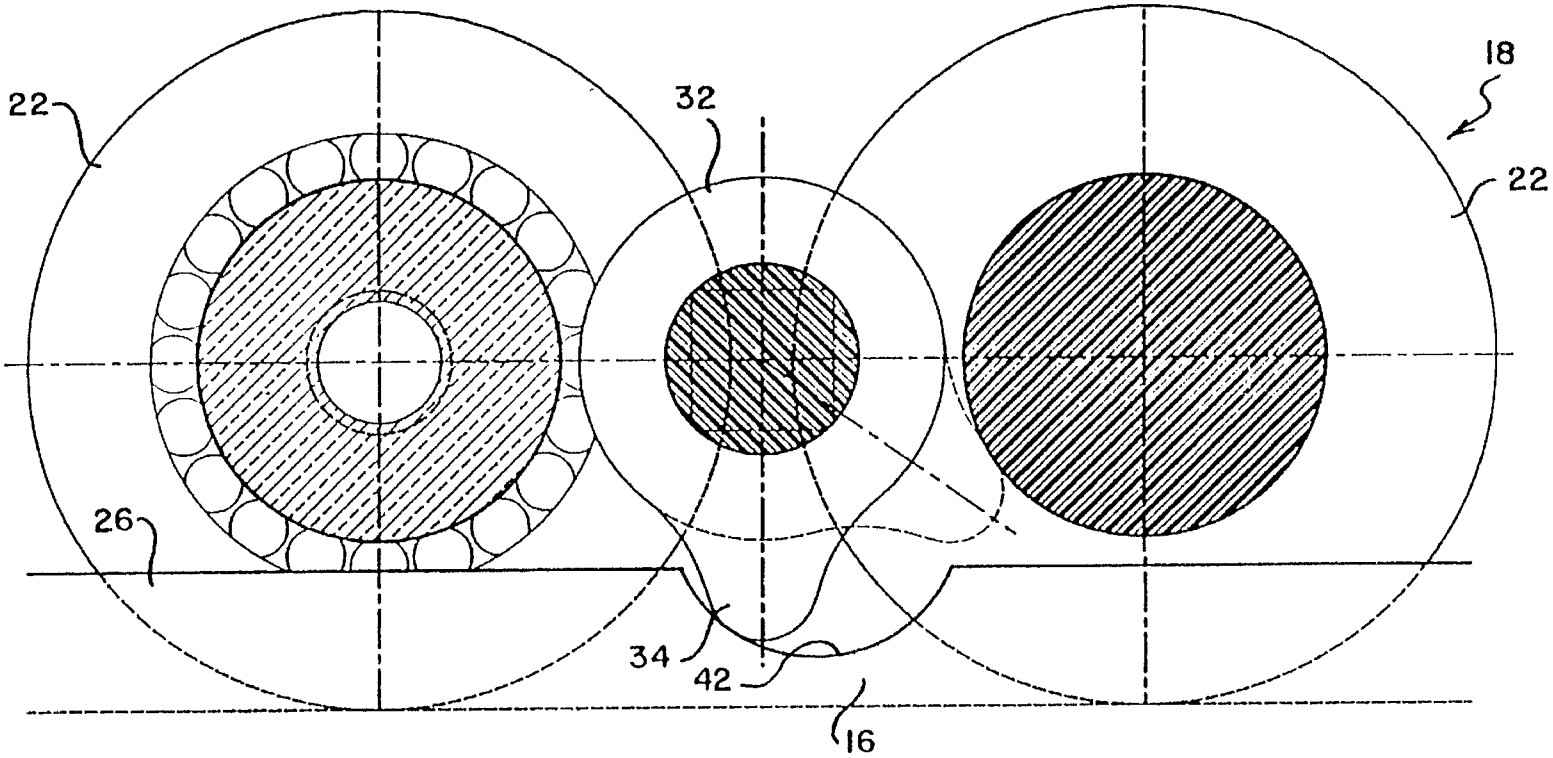
FIG. 3 is a section on III—III in FIG. 2.

When the cam element 32 is in the position shown in dotted lines in FIG. 3, the runner assembly 18 is free to move long the track 16. When, however, the cam lever 40 is moved to the position shown in solid lines in FIG. 4, the cam element 32 is displaced to the position shown in solid lines in FIG. 3. This causes the protruding portion 34 to move into a recess 42 in the lip 26. This has the effect of locking the runner assembly in position with respect to the track 16. The engagement of the cam 32 with the lip 26 could also be frictional, in which event the recess 42 need not be provided.

Figure 4:
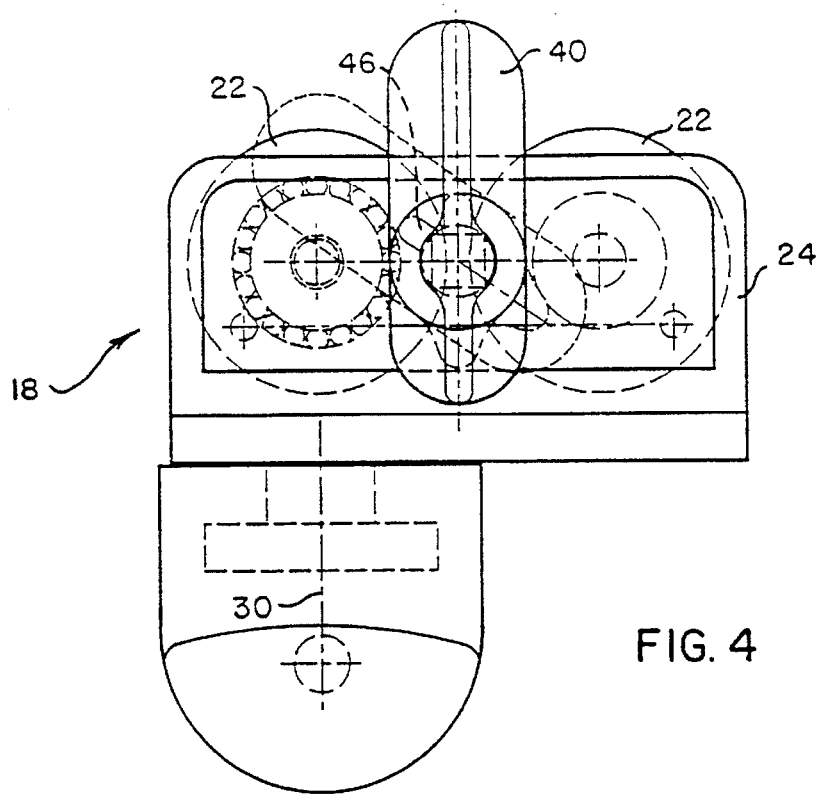
FIG. 4 is a side view of the runner assembly.
Figure 2:
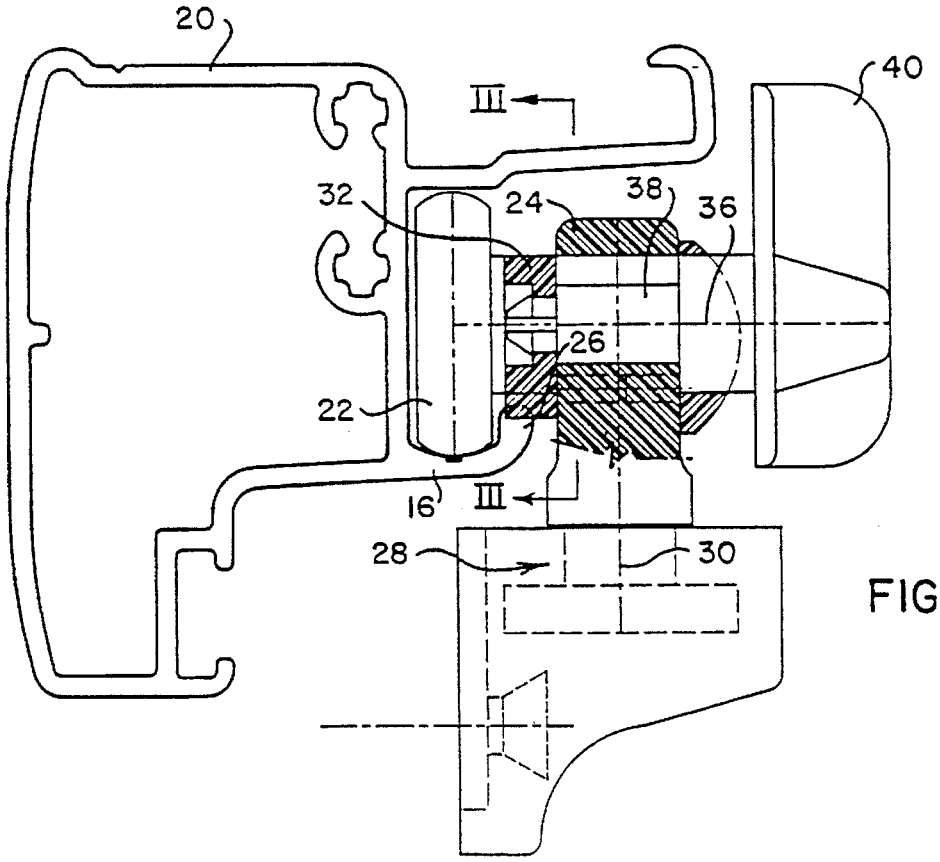
FIG. 2 is section through the upper part of the door, a head track, and a runner assembly via which the door is supported on the head track, in accordance with the invention.
Figure 7:
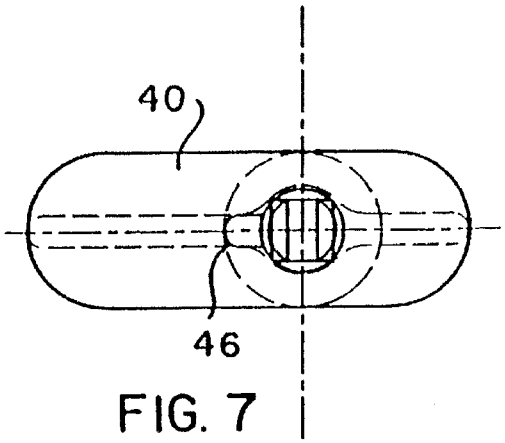
FIG. 7 is an end view of the cam operating lever.
Figure 6:
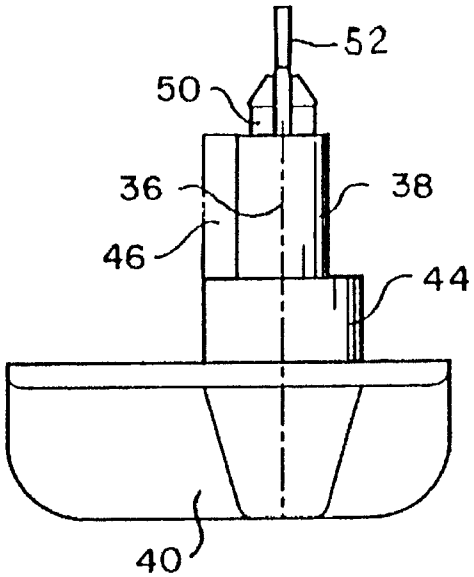
FIG. 6 is plan view of a cam operating lever forming part of the assembly.
Figure 5:
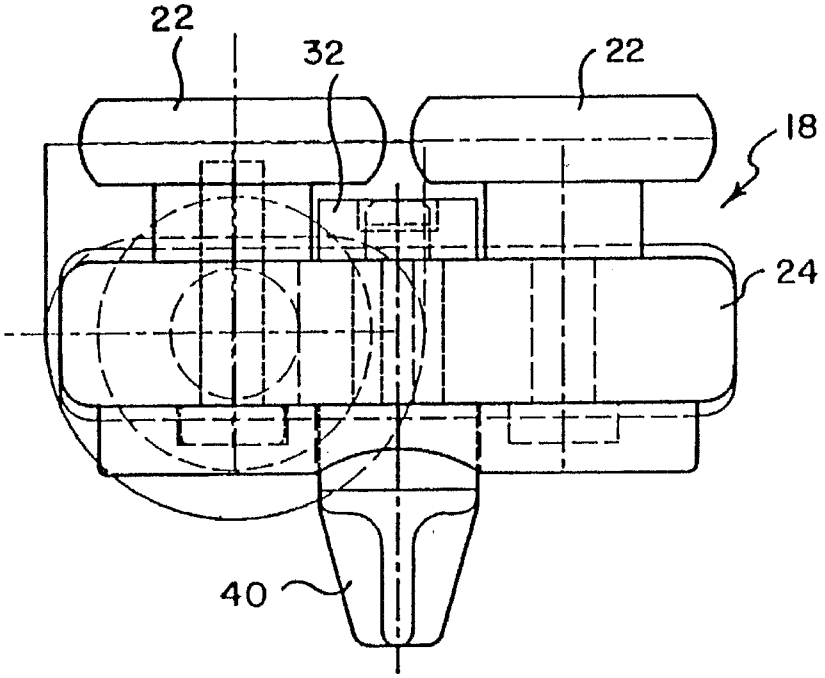
FIG. 5 is a view from above of the runner assembly.

As can best be seen in FIGS. 4 and 6, there is a collar 44 between the shaft 38 and the cam lever 40, and a radially protruding tooth 46 which extends from the collar to the end Of the shaft 38. The tooth 46 enters into a recess (not shown) in the runner body 24. The recess has a circumferential extent which is such that its circumferential end faces act as stops to limit displacement of the cam lever 40 and thus the cam element 32 about the cam axis 36 to an angle of about 60°.

The shaft 38 has a split end portion 50 which is rectangular in cross-section, and the cam element 32 has a correspondingly shaped square opening. When assembling the runner assembly 18, the shaft 38 is inserted into the bore in the runner body from one side, and the cam element 32 is then clipped onto the end portion 50. An integrally moulded wedge 52 is then driven between the split ends of the portion 50, to locate the cam element firmly in position on the shaft.

The construction of the runner assemblies 18 at the bottom of the door panels 12.1 and 12.2 will be similar to that described above.

It is an advantage of the construction herein described and illustrated that either end of the door can easily be locked in position with respect to the head and cill tracks. This can be done by simply flicking the cam levers 40, top and bottom, from one position to the other. Thus, if it is desired for the door to open to the right, the right hand end of the door is locked, whereas, if it is desired for the door to be opened to the left, the left hand end of the door is locked. The decision as to whether to configure the door so that it opens to the right or to the left may be influenced by the configuration of the shower taps and rose, and having a bifold door as described herein with reference to the drawings will leave the end user with as much flexibility as possible in this regard. The door will also enable the end which is normally fixed to be opened from time to time, to facilitate cleaning of the door and surroundings in that region.

I claim:

1. A bifold door which comprises a pair of door panels joined to one another along a centre hinge having a vertical hinge axis, each door panel being, at the end thereof remote from the centre hinge, pivotal about a pivot axis parallel to the hinge axis, and each of the door panels being supported, at the end thereof remote from the centre hinge, by an upper runner assembly on an upper track and by a lower runner assembly on a lower track, each runner assembly being provided with an element which in a first operative position restrains the runner assembly against movement along the track and in a second inoperative position permits the runner assembly to move along the track, the relationship between each element and its track being such that a force exerted on a door panel and tending to move the door panel along the track can displace the elements from their first positions to their second positions thereby overcoming the restraining action exerted by said elements on the door panel and permit the runner assemblies supporting that panel to move along the tracks.

2. A bifold door as claimed in claim 1, wherein said element of each assembly comprises a cam which is rotatable with respect to the runner assembly about a cam axis, rotation of the cam about the cam axis displacing the cam between said first and second positions.

3. A bifold door as claimed in claim 2, wherein the tracks have recesses therein into which recesses parts of the cams enter when they are in their first positions.

4. A bifold door as claimed in claim 2, wherein each cam in its first position bears on the track so that there is frictional engagement between the track and the cam.

5. A bifold door as claimed in claim 2, wherein each runner assembly comprises a pair of runner wheels which are spaced apart along the track, the cam being disposed between the runner wheels.

6. A bifold door as claimed in claim 3, wherein each runner assembly comprises a pair of runner wheels which are spaced apart along the track, the cam being disposed between the runner wheels.

7. A bifold door as claimed in claim 4, wherein each runner assembly comprises a pair of runner wheels which are spaced apart along the track, the cam being disposed between the runner wheels.

8. A bifold door as claimed in claim 2, wherein the track has a lip on one side of the runner wheels for limiting transverse movement of the runner wheels with respect to the track, the cam being arranged to engage the lip.

* * * * *